United States Patent [19]

Walker

[11] Patent Number: 4,543,899

[45] Date of Patent: Oct. 1, 1985

[54] SELF-TRIMMING SAILSET

[76] Inventor: John G. Walker, 31 Abbeyfields Close, Netley Abbey, Hampshire, England

[21] Appl. No.: 509,445

[22] PCT Filed: Oct. 11, 1982

[86] PCT No.: PCT/GB82/00290

§ 371 Date: Jun. 13, 1983

§ 102(e) Date: Jun. 13, 1983

[87] PCT Pub. No.: WO83/01427

PCT Pub. Date: Apr. 28, 1983

[30] Foreign Application Priority Data

Oct. 13, 1981 [GB] United Kingdom ..... 8130874

[51] Int. Cl.[4] ..... B63H 9/04

[52] U.S. Cl. ..... 114/39; 114/102; 114/97

[58] Field of Search ..... 114/39, 102, 103, 90, 114/97, 98, 91, 39.1; 244/48, 82

[56] References Cited

U.S. PATENT DOCUMENTS

| | | | |
|---|---|---|---|
| 3,247,821 | 4/1966 | Craig | 114/102 |
| 3,968,765 | 7/1976 | Menegus | 114/102 |
| 4,124,180 | 11/1978 | Wolowicz | 244/82 |

FOREIGN PATENT DOCUMENTS

| | | | |
|---|---|---|---|
| 403416 | 9/1924 | Fed. Rep. of Germany | 114/102 |
| 198649 | 5/1924 | United Kingdom . | |

*Primary Examiner*—Trygve M. Blix
*Assistant Examiner*—Edwin L. Swinehart
*Attorney, Agent, or Firm*—Roylance, Abrams, Berdo & Goodman

[57] ABSTRACT

A principal sail (1) rotates about an erect axis (2) and an auxiliary sail or vane (3) is mounted downstream of the principal sail (1). The vane (3) is mounted on a boom (4) that extends from the principal sail (1) so that the principal sail (1) is trimmed as the tail vane (3) moves to its position of minimum drag. A second auxiliary vane (5) is mounted forwards of the leading edge of the principal sail (1) and is capable of opposing the moment of the principal sail (1) about its own axis as the principal sail is moved towards a stalling position.

4 Claims, 7 Drawing Figures

SELF-TRIMMING SAILSET

This invention relates to sails for marine or terrestrial vessels, and especially to self-trimming sailsets.

A known type of self-trimming sailset consists of a principal sail that is rotatable about an erect axis and an auxiliary sail or "tail vane" that is carried downstream of the principal sail. This tail vane is mounted on a boom that extends from the principal sail so that thrust on the tail vane rotates the tail vane and boom about the erect axis and causes rotation of the principal sail. In operation, the angle of the tail vane, with respect to the principal sail, is set, the resulting thrust of the wind on the tail vane urging the tail vane and boom towards the position of minimum drag for the tail vane and thus causing rotation of the principal sail to an angle of attack predetermined by the setting of the tail vane.

These self-trimming sailsets have advantages over conventional sailing rigs in terms of controllability, efficiency and drive, but tend to suffer from relatively poor downwind performance due to the inability of the tail vane to stall fully the principal sail.

The present invention is directed towards alleviating the aforesaid disadvantage of self-trimming sailsets.

According to one aspect of the invention there is provided a self-trimming sailset including an auxiliary vane capable of being positioned forwards (i.e. usually upwind) of the leading edge of the principal sail and such that thrust on the auxiliary vane causes rotation of the principal sail.

Another aspect of the invention provides a self-trimming sailset including at least one auxiliary vane that is capable of opposing the moment of the principal sail about its own axis as the principal sail is moved towards a stalling position.

The auxiliary vane is preferably rigid, most preferably a rigid aerofoil of symmetrical section that is pivoted ahead of its centre of pressure.

The sailset preferably comprises counterbalancing weights which may be incorporated into the auxiliary vane or be carried by a boom on which the auxiliary vane is mounted.

The invention will now be described by way of example with reference to the accompanying drawings in which.

Figure 1:
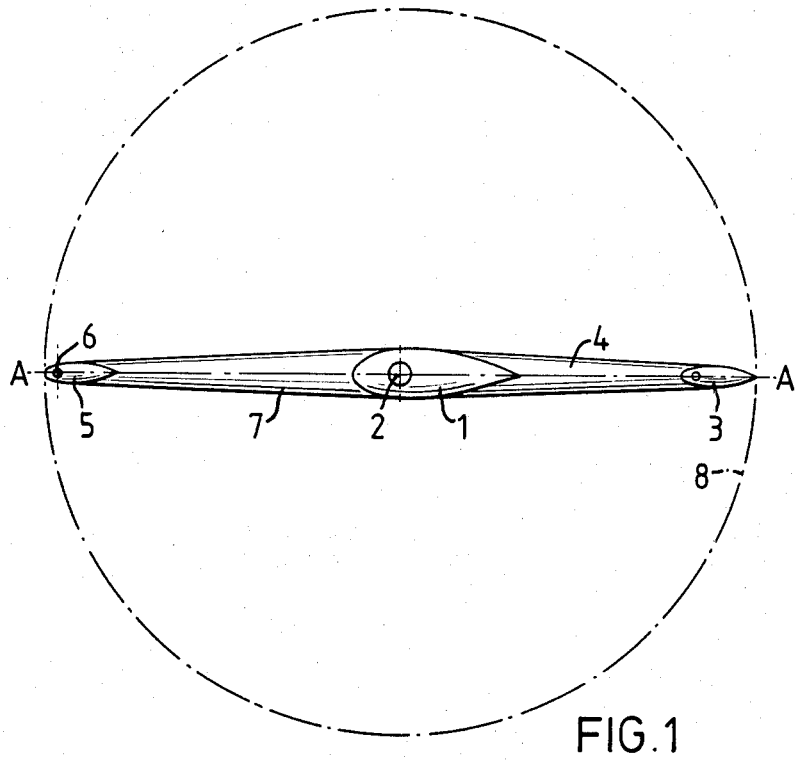
FIG. 1 is a schematic plan view of a self-trimming sailset in accordance with an embodiment of the invention.

Referring to FIG. 1, there is a principal sail 1, shown as a symmetrical section aerofoil, which is freely rotatable about an erect axis 2, and a tail vane 3 mounted on a boom 4 that extends from the principal sail 1. In addition to the tail vane 3 there is a second auxiliary vane that in non-stalling conditions is positioned upwind of the principal sail. This second auxiliary vane, referred to herein as forward vane 5, also extends on a boom 7 from the principal sail 1.

The axis 2 of the principal sail 1 is positioned on the chord of the aerofoil section at a distance from the leading edge of the aerofoil that is within the zone in which the centre of pressure of the aerofoil generally occurs in non-stalled modes of operation. This zone will generally lie in the range from 22% to 40% of the chord length measured from the leading edge. The tail vane 3 is also pivoted about an erect axis preferably within the zone in which its centre of pressure generally occurs. The forward vane 5 is freely pivoted about an erect axis 6 the location of which is upstream of the zone in which its centre of pressure generally occurs, preferably in the range of 0% to 18% of the chord length measured from the leading edge although the forward vane 5 may be pivoted about an axis disposed forwards of its leading edge.

Figure 2:
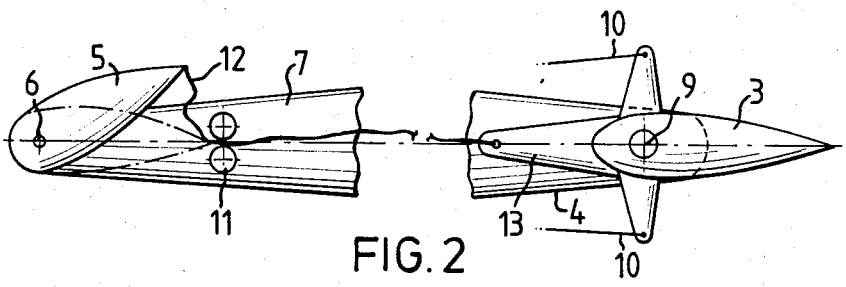
FIG. 2 is an enlarged schematic plan view of the auxiliary sails of the sailset of FIG. 1.

FIG. 2 shows an enlarged view of the extremities of the booms 4 and 7 carrying respectively the tail vane 3 and forward vane 5, from which it can be seen that the trailing edge of the forward vane 5 is linked to the tail vane by a rope 12. The rope 12 passes through guides 11, such as sheaves, and at the tail vane 3 is attached to an extension 13 that projects forwards of the tail vane. The length of the rope 12 is such that it remains slack as the tail vane 3 is moved between its normal operating positions (that is positions in which the principal sail is not stalled) by means of arms 10, a typical arrangement allowing the rope 12 to remain slack while the tail vane is deviated by up to at least 30° in either direction. When rope 12 is slack the forward vane 5 is able to align itself to the local air flow in a "weathercocking" fashion, but when rope 12 is pulled taut by deviating the tail vane 3 beyond its normal range of operating positions the forward vane 5 is pulled towards alignment with the boom 7 and held so that thrust of the wind on the forward vane 5 causes the forward vane to move on its boom about the axis 2 of the principal sail, and thus alter the alignment of the principal sail with respect to the wind.

Figure 3:
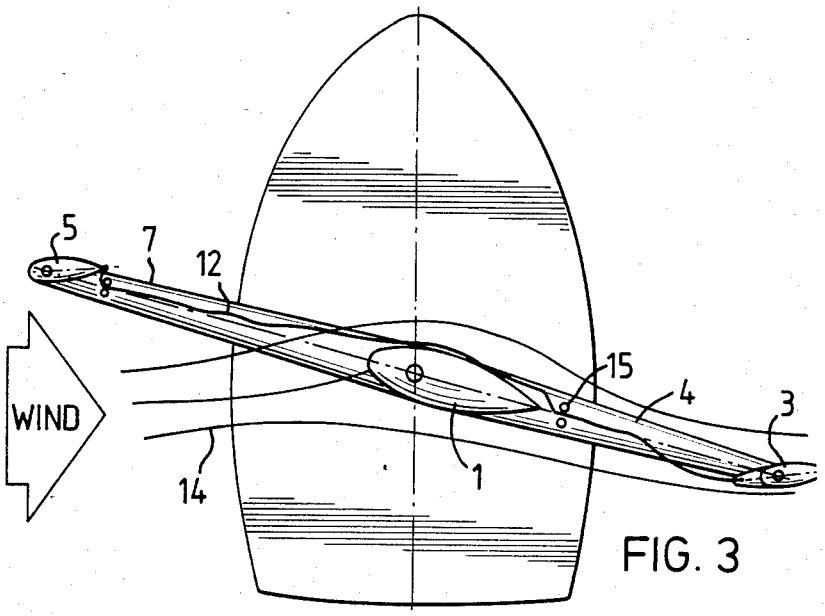
FIGS. 3 and 4 show, respectively, in schematic plan view, the configuration of the sailset of FIG. 1 adopted for port and starboard tacking.
Figure 4:
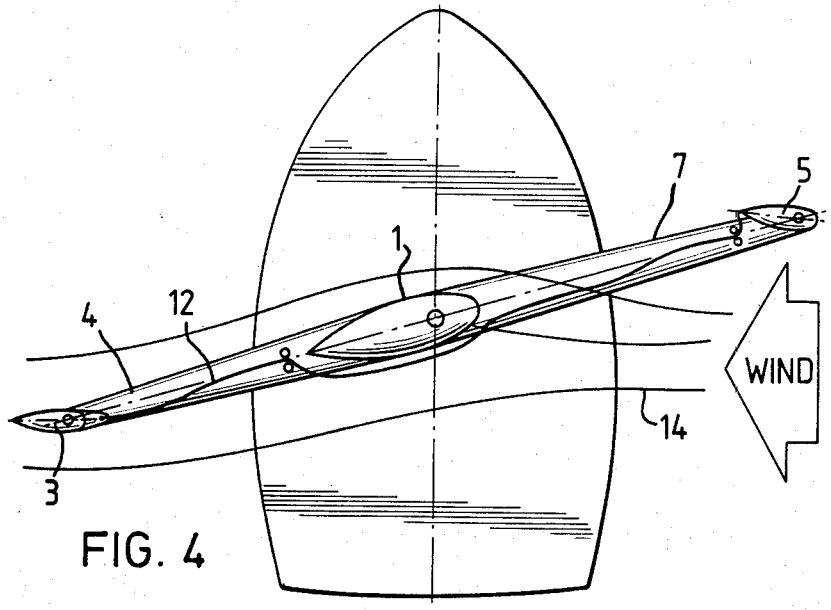

FIGS. 3 and 4 illustrate the general conditions for, respectively, unstalled port and starboard tacking. In these Figures flow lines 14 indicate the airflow, and it can be seen that, in each case, the principal sail 1 is positioned at the desired angle of attack by the setting of the tail vane 3 which is urged towards its position of minimum drag, the rotation of the boom 4 as the tail vane 3 takes up this position having served to rotate the principal sail 1. Thus in this embodiment the tail vane 3 acts as a regulator which, once set, renders the sailset self-trimming. The setting of the tail vane 3 is such that rope 12 is slack and therefore the forward vane 5 "weathercocks" to align with the local air flow by virtue of being pivoted ahead of its centre of pressure.

Figure 6:
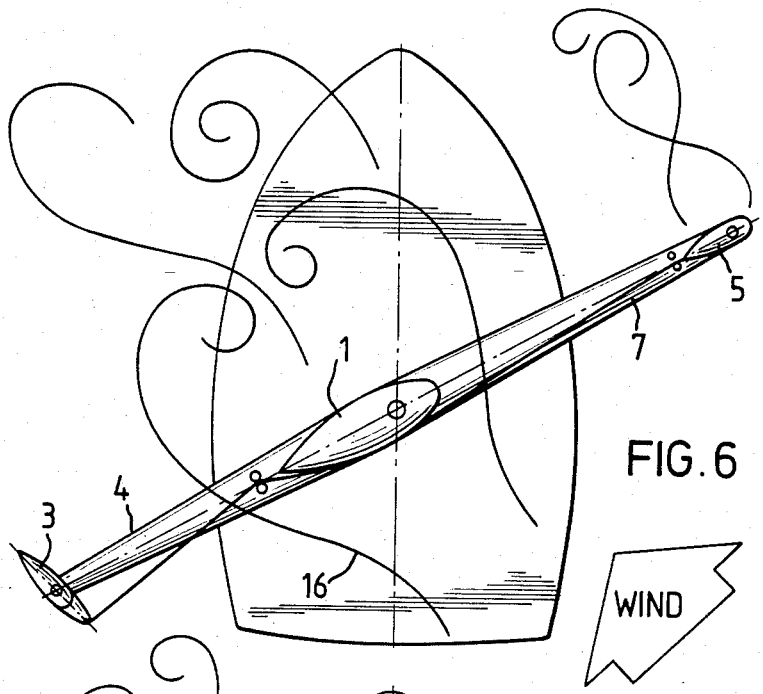
FIGS. 5 and 6 show in schematic plan view the sailset of FIG. 1 in the configuration adopted for port and starboard stalling.
Figure 5:
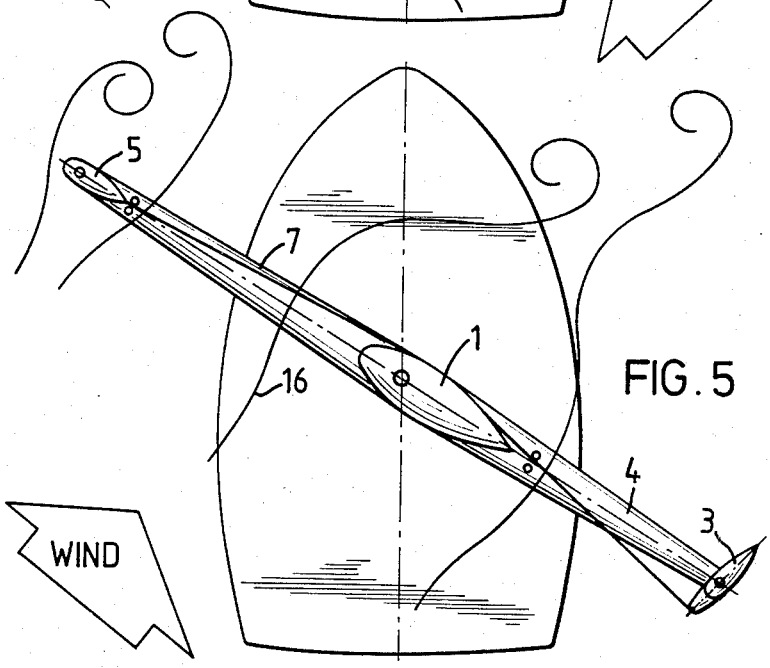

FIGS. 5 and 6 show respectively the sailset configuration that is necessary for port and starboard stalling, as may be required when sailing downwind. As shown, the tail vane 3 has been deviated to the extreme angle of about 90°, thus pulling the rope 12 taut and aligning the forward vane 5 with the boom 7. With the forward vane 5 so fixed, the thrust of the wind tends to turn the forward vane 5 on its boom 7 about the axis 2 of the principal sail 1 until both the principal sail and forward vane stall as depicted in FIGS. 5 and 6; flow lines 16 represent the fully stalled eddying flow of air about the stalled aerofoils.

The precise extent to which the tail vane 3 must be deviated to make the rope 12 taut depends on the length of the rope and the relative length of other members such as the extensions 13. As shown the tail vane is aligned with the wind direction and the forward vane is aligned with its boom, however it is merely necessary for the helmsman to deviate the tail vane through the maximum angle that the rope permits, which in an alternative embodiment need not fully align (or centralise) the forward vane with respect to its boom.

In the above description, the axis 2 of the principal sail 1 has been described as in the zone in which the centre of pressure of the principal sail generally occurs. However, as the principal sail is rotated towards an angle of attack of 90°, in order to achieve stalling, the centre of pressure moves along the chord, away from the leading edge, until eventually there is a significant moment about the axis 2 due to thrust on the principal sail 1 itself, acting to oppose rotation into a stalling position. Thus it may be seen that the forward vane 5 acts to oppose the moment of the principal sail 1 about its own axis as the principal sail is moved to the stalling position. Under these conditions an equilibrium is eventually reached where the moment of the forward vane equals the moment of the principal sail, about axis 2. The area of the forward vane is chosen so as to cause a net angle of attack substantially greater than that corresponding to stalling conditions.

Figure 7:
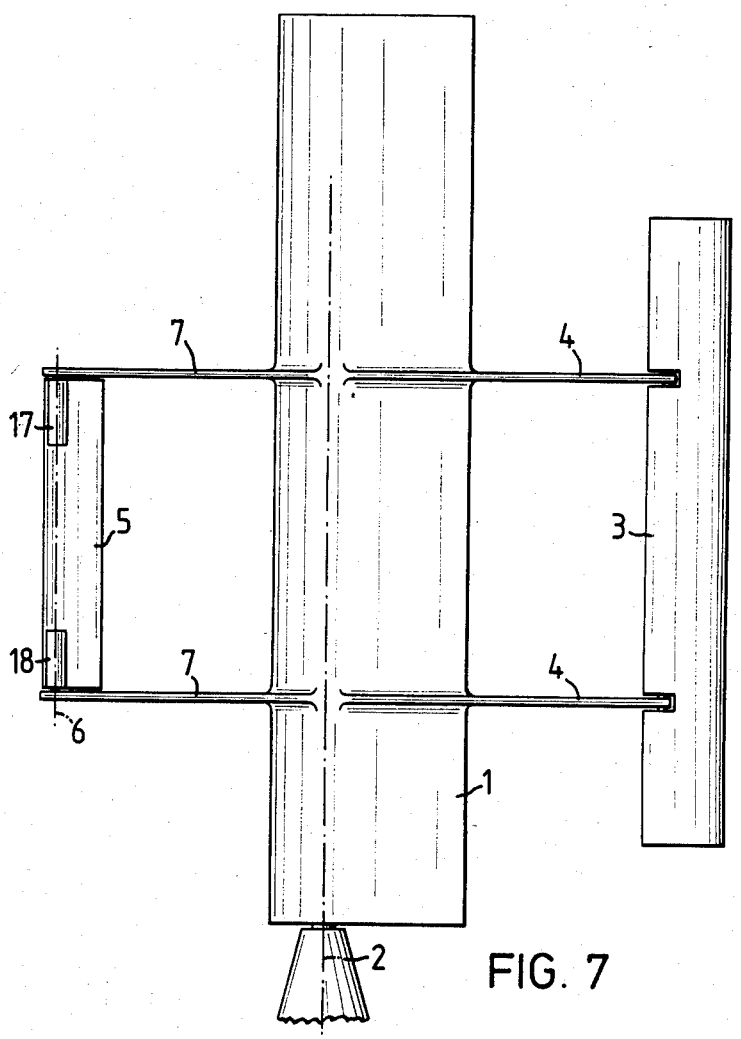
FIG. 7 shows a side view of the sailset of FIG. 1.

FIG. 7 illustrates a side view of a sailset similar to that shown in FIGS. 1 to 6.

In FIGS. 1 to 7 the principal sail 1 and the auxiliary sails, i.e. tail vane 3 and forward vane 5, are shown as single rigid symmetrical aerofoils, however each may be a cloth sail and/or may be a multi-element sail, and in the case of the auxiliary sails being multi-element they may be mounted on one or a plurality of booms. Also while symmetry about the axis A—A, shown in FIG. 1, is preferable it is not essential.

In a preferred embodiment, the boom (or booms) 7 or the forward vane (or vanes) 5 carry balance weights for counterbalancing the sailset about the principal sail axis 2, for example as shown by weights 17 and 18 in FIG. 7. Alternatively the weights may be constituted by a bar extending from the boom or booms, the forward vane being pivoted upon the bar. The boom 7, in addition to rotating about axis 2 may be pivoted to the principal sail 1 near its leading edge to allow rotation of the boom 7 for relocation of the balance weights without causing rotation of the principal sail. In this instance the pivoting action of the boom about the leading edge of the principal sail 1 is inhibited by some means, such as a locking device, when it is desired to use the forward vane to rotate the principal sail.

The loci of the forward vane 5 and tail vane 3, shown as circle 8 in FIG. 1 where the loci coincide as the leading edge of the forward vane and the trailing edge of the tail vane are equidistant from axis 2, preferably lie within the plan outline of the vessel so as to minimise the danger of accidental fouling of the sailset. (FIGS. 3 to 6, for simplicity, depict a smaller vessel outline). In order to reduce the moment of inertia of the sailset it is preferable to have the leading edge of the forward vane 5 closer to the axis 2 than the trailing edge of the tail vane 3.

It is envisaged that the rope 12 for fixing the forward vane 5 could be replaced by other linkages such as push rods or bell cranks, or even replaced by a servo mechanism. Furthermore, it is not essential that the forward vane, when operating to rotate the principal sail, be fixed in parallel alignment with the boom, as shown in the Figures, for example the or each forward vane may be mounted off centre with respect to its boom.

Alternative arrangements for fixing the forward vane, other than by maximum deflection of the control for the tail vane, are envisaged. For example flaps on the principal sail may be linked to the forward vane, or there may be a linkage only from the forward vane to its boom. If the control of the forward vane is to be manual it is desirable that the operation consist of movement of a control member to an extreme position, such as the described movement of the control for the tail vane, or movement of the forward vane boom to an extreme position.

The forward vane may also constitute a fairing for the counterbalancing weights.

I claim:

1. A self-trimming sail set comprising:

an upright principal sail mounted freely for rotation about an upright axis;

a tail vane settable for controlling the angle of attack of the principal sail to the wind;

an auxiliary vane mounted in a position normally upstream of the principal sail; and control means for setting the auxiliary vane to oppose the moment of the principal sail about its said axis when the tail vane is set to cause the principal sail to move towards a stalled condition, said control means being operable to allow said auxiliary vane to weathercock when said tail vane is set for a normal non-stalling condition of said principal sail.

2. In a self-trimming sailset including a principal rigid aerofoil sail mounted freely for rotation about an upright axis and a rigid control aerofoil for controlling the angle of attack of the principal sail to the wind, the control aerofoil being settable to cause the principal sail to rotate towards a stalled condition such that the center of pressure of said principal sail shifts to produce a moment opposing the rotation of the principal sail towards said stalled condition, apparatus for opposing said moment and assisting the principal sail to achieve a fully stalled condition, said apparatus comprising:

an upright auxiliary rigid aerofoil, said auxiliary aerofoil being mounted for rotation about an upright axis positioned ahead of the center of pressure of said auxiliary aerofoil, whereby said auxiliary aerofoil cna weathercock; and means for setting said auxiliary aerofoil at a selected angle such that wind thrust on said auxiliary aerofoil opposes said moment.

3. A self-trimming sailset comprising:

an upright rigid principal aerofoil freely mounted for rotation about an upright axis;

an upright rigid control aerofoil pivoted for movement about an upright axis, said control aerofoil controlling the angle of attack of said principal aerofoil to the wind;

an upright rigid auxiliary vane pivoted about an upright axis forwardly of its center of pressure, said auxiliary vane being positionable forwards of said principal aerofoil; and control means for linking said control aerofoil and said auxiliary vane, said control means permitting said auxiliary vane to weathercock when said control aerofoil is set for non-stalling operation of said principal aerofoil and setting said auxiliary vane to a selected angle when said control aerofoil is set to cause said principal aerofoil to move to a stalled position.

4. A sailset according to claim 3 wherein said selected angle is such that the auxiliary vane is aligned with said principal aerofoil.

* * * * *